US011400354B2

(12) United States Patent
Allen et al.

(10) Patent No.: US 11,400,354 B2
(45) Date of Patent: Aug. 2, 2022

(54) PORTABLE OUTDOOR GAME

(71) Applicant: NEWPORT INNOVATIONS L.L.C., South Jordan, UT (US)

(72) Inventors: Craig Lee Allen, South Jordan, UT (US); Denice Allen, South Jordan, UT (US)

(73) Assignee: NEWPORT INNOVATIONS L.L.C., South Jordan, UT (US)

( * ) Notice: Subject to any disclaimer, the term of this patent is extended or adjusted under 35 U.S.C. 154(b) by 0 days.

(21) Appl. No.: 17/174,339

(22) Filed: Feb. 11, 2021

(65) Prior Publication Data

US 2021/0252362 A1 Aug. 19, 2021

Related U.S. Application Data

(60) Provisional application No. 62/977,244, filed on Feb. 16, 2020.

(51) Int. Cl.
*A63B 67/06* (2006.01)
*A63F 7/00* (2006.01)

(52) U.S. Cl.
CPC ..... *A63B 67/066* (2013.01); *A63B 2067/061* (2013.01); *A63B 2067/063* (2013.01); *A63B 2210/50* (2013.01); *A63F 2007/0011* (2013.01)

(58) Field of Classification Search
CPC ..... A63B 67/02; A63B 67/06; A63B 67/066; A63B 67/12; A63F 2007/3625; A63F 2007/3655; A63F 2007/0011; A45B 2023/0006; E04H 15/003–005; E04H 15/00–30; E04H 15/54
See application file for complete search history.

(56) References Cited

U.S. PATENT DOCUMENTS 1,262,314 A * 4/1918 Downey ..... A63F 7/0005 273/352
1,545,772 A * 7/1925 Jacobs ..... A63B 57/40 473/190
1,577,250 A * 3/1926 Corp ..... A63B 67/06 124/17
1,785,953 A * 12/1930 Hanan ..... A47G 9/062 5/418
2,277,742 A * 3/1942 Crawford ..... E04H 15/54 135/119

(Continued)

OTHER PUBLICATIONS

Business & Pleasure Co. Holiday Beach Tents, businessandpleasureco.com/collections/holiday-beach-tents, archived by the Internet Archive on Apr. 17, 2019 (Year: 2019).*

(Continued)

*Primary Examiner* — Laura Davison
(74) *Attorney, Agent, or Firm* — Maschoff Brennan

(57) ABSTRACT

A portable outdoor game that may include a ramp, a target, and one or more projectiles. The ramp may include an elongated runner and an elevation structure. The elevation structure may be positioned at one end of the runner and lift that end of the runner from a playing surface, creating an angled incline in the runner relative to the playing surface. Projectiles may roll or slide across the runner in the direction of the elevation structure. The projectiles may become airborne after traveling over the elevation structure and land within or near the target.

20 Claims, 9 Drawing Sheets

(56) References Cited

U.S. PATENT DOCUMENTS 2,327,702 A * 8/1943 Flynt ..... A63H 27/004 446/63
2,660,186 A * 11/1953 Marshall ..... E04H 15/003 135/153
2,848,756 A * 8/1958 McCann ..... E04H 15/003 52/63
3,009,700 A * 11/1961 Dolega ..... A63B 67/12 273/348
3,106,399 A * 10/1963 Bibanoff ..... A63B 67/00 273/393
3,195,267 A * 7/1965 Gehlen ..... A63F 7/40 446/168
3,368,814 A * 2/1968 Kolwicz ..... A63F 9/02 273/342
3,891,213 A * 6/1975 Cooper ..... A63B 63/08 273/352
3,912,271 A * 10/1975 Stevenson ..... A63F 9/0252 273/317
4,045,032 A * 8/1977 Cox ..... A63B 71/022 473/197
4,232,489 A * 11/1980 Corvington ..... B32B 29/007 52/63
4,336,939 A * 6/1982 Krumlauf ..... A63F 7/0628 473/183
5,031,919 A 7/1991 Dixon
5,080,123 A * 1/1992 Stein ..... E04H 15/003 135/114
5,435,570 A 7/1995 Labrasseur
5,823,885 A * 10/1998 Stempfer ..... A63B 71/022 473/197
6,100,208 A * 8/2000 Brown ..... B32B 27/20 442/364
7,121,963 B2 * 10/2006 Corbin ..... A63B 67/002 473/410
8,807,565 B2 8/2014 Monopoli
10,188,922 B1 * 1/2019 Bahash ..... A63B 67/02
10,406,416 B2 * 9/2019 Cohen ..... A63B 67/02
11,065,519 B1 * 7/2021 Bahash ..... A63B 67/02
2016/0192783 A1 * 7/2016 Kelly ..... A47C 4/28 135/96
2019/0030409 A1 * 1/2019 Von Bokel ..... A63B 67/002

OTHER PUBLICATIONS

Quest RampSkee, www.fatherly.com/gear/big-sale-today-backyard-games-tailgating/, posted Oct. 11, 2018 (Year: 2018).*

* cited by examiner

PORTABLE OUTDOOR GAME

RELATED APPLICATION

This application claims priority under 35 U.S.C. § 119 to U.S. Provisional Application No. 62/977,244, filed Feb. 16, 2020, the entire disclosure of which is incorporated herein by reference.

BACKGROUND

Many outdoor games require a large playing area. Some games require a specially designed park, field, or course. In order to even gain access to some of these playing areas, a fee must be paid. In addition, many of these games require players to have a significant amount of expensive gear. Even outdoor games that are portable may require a large playing area. The process for setting up and taking down portable outdoor games is often time consuming and difficult. In addition, many portable outdoor games are bulky and heavy and do not collapse down to a size that is simple to transport and store when the game is not in use.

A portable outdoor game that does not require a large playing area, that is lightweight, and that is easy to set up and take down would solve many of the disadvantages that exist with current outdoor games. It would further be beneficial for the portable outdoor game to be collapsible so that, when the game is not in use, it requires only a small amount of space for storage. Finally, it would be beneficial for the outdoor game to provide users with some amount of physical exercise while playing the game. The subject matter of the present application provides these and other benefits over currently available outdoor games.

The subject matter claimed in the present disclosure is not limited to embodiments that provide any of the advantages or solve any of the disadvantages described above.

SUMMARY

In one embodiment a portable outdoor game is provided. The portable outdoor game may have a ramp that includes an elevation structure. The elevation structure may include one or more legs and a cross member. One end of the one or more legs may rest on an underlying playing surface, while an opposite end of the legs may be attached to the cross member. The elevation structure may also include a flexible runner that has a first end and a second end. The first end of the runner may have one or more grommets through which one or more stakes may be inserted, to secure the runner to the underlying playing surface. The second end of the runner may be secured to the cross member. The elevation structure may further include anchor lines that are attached to the elevation structure at one end and that may be secured to the underlying playing surface at the other end. The elevation structure may be held in an upright position on the legs by the ramp on one side and the anchor lines on an opposite side. The portable outdoor game may also include a target that lacks any connection to the ramp and rests on the playing surface. The portable outdoor game may further include projectiles that are configured to travel across the runner.

In some embodiments, the ramp of the portable outdoor game may include a first leg and a second leg. The first leg may be attached to one end of the cross member and the second leg may be attached to an opposite end of the cross member.

In some embodiments, the one or more legs may be removably attached to the cross member, such that the one or more legs may be reoriented relative to the cross member.

In some embodiments, the one or more legs may be pivotally attached to the cross member, such that the one or more legs may be reoriented relative to the cross member.

In some embodiments, the elevation structure may also include a cushion member that is attached to the cross member and extends below at least a portion of the runner.

In some embodiments, the runner may include a top side and a bottom side. One or more guides that provide indicators for the projectiles may be printed on the top side of the runner.

In some embodiments, the bottom side of the runner may include a waterproof or water-resistant material.

In some embodiments, the target may be a length of cord. The cord may be connected at each end to create a closed loop. In other embodiments, the cord may not be connected at each end.

In some embodiments, the projectiles are balls that are configured to roll across the runner.

In another embodiment, a ramp that is configured to be used in a portable outdoor game is disclosed. The ramp may include an elevation structure that includes a first leg, a second leg, and a cross member having a first end and a second end. The first end of the cross member may be attached to the first leg and the second end of the cross member may be attached to the second leg. The ramp may also include an elongated runner having a first end and a second end. The first end of the elongated runner may have one or more grommets through which one or more stakes may be inserted to secure the runner to an underlying playing surface. The second end of the elongated runner may be secured to the cross member. The ramp may further include a cushion member that is positioned between the runner and the cross member. The ramp may also include one or more anchor lines that are attached to the elevation structure at one end and configured to be secured to the underlying playing surface at the other end. The elevation structure may be held in an upright position on the first and second legs by the ramp on one side and the one or more anchor lines on an opposite side.

In some embodiments, the runner may have a top side and a bottom side and the cushion member may be secured to the bottom side of the runner.

In some embodiments, the cushion member may be secured to the bottom side of the runner by an adhesive.

In some embodiments, the cushion member may be secured to the elevation structure.

In some embodiments, the cushion member may be made from rubber or foam.

In some embodiments, the cushion member may extend from the elevation structure and below the runner for a distance of at least 1 inch from the elevation structure.

In some embodiments, the cushion member may have a thickness of approximately 2 millimeters.

In some embodiments, the first and second legs may be pivotally attached to the cross member such that the first and second legs may be reoriented relative to the cross member.

In some embodiments, the runner may include a top side and a bottom side. One or more guides lines or arrows may be printed on the top side of the runner.

In some embodiments, the bottom side of the runner may include a waterproof or water-resistant material.

In another embodiment, a portable outdoor game is disclosed. The portable outdoor game may include a ramp that has an elevation structure. The elevation structure may include a first leg, a second leg, and a cross member having a first end and a second end. The first end of the cross member may be attached to the first leg and the second end of the cross member may be attached to the second leg. The first and second legs may be attached to the cross member in a manner that allows the first and second legs to be reoriented relative to the cross member. The elevation structure may also include an elongated runner having a first end and a second end. The first end of the elongated runner may have one or more grommets through which one or more stakes may be inserted to secure the runner to an underlying playing surface. The second end of the elongated runner may be secured to the cross member. The elevation structure may further include a cushion member that is positioned below at least a portion of the second end of the elongated runner and between the elongated runner and the cross member. The elevation structure may finally include one or more anchor lines that are attached to the elevation structure at one end and may be secured to the underlying playing surface at the other end. The elevation structure may be configured to be held in an upright position on the first and second legs by the ramp on one side and the one or more anchor lines on an opposite side. The portable outdoor game may also include a target that is configured to rest on the playing surface. The target may lack any connection to the ramp. The portable outdoor game may further include one or more projectiles that are configured to travel across the runner.

In some embodiments, the playing surface may be a natural surface.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

DETAILED DESCRIPTION

According to one embodiment of the present disclosure, a portable outdoor game is disclosed. The portable outdoor game may include a ramp that has an elevation structure. The elevation structure may include a first leg, a second leg, and a cross member having a first end and a second end. The first end of the cross member may be attached to the first leg and the second end of the cross member may be attached to the second leg. The first and second legs may be attached to the cross member in a manner that allows the first and second legs to be reoriented relative to the cross member. The elevation structure may also include an elongated runner having a first end and a second end. The first end of the elongated runner may have one or more grommets through which one or more stakes may be inserted to secure the runner to an underlying playing surface. The second end of the elongated runner may be secured to the cross member. The elevation structure may further include a cushion member that is positioned below at least a portion of the second end of the elongated runner and between the elongated runner and the cross member. The elevation structure may finally include one or more anchor lines that are attached to the elevation structure at one end and may be secured to the underlying playing surface at the other end. The elevation structure may be configured to be held in an upright position on the first and second legs by the ramp on one side and the one or more anchor lines on an opposite side. The portable outdoor game may also include a target that is configured to rest on the playing surface. The target may lack any connection to the ramp. The portable outdoor game may further include one or more projectiles that are configured to travel across the runner and into an area where the targets are located.

The outdoor game of the present disclosure possesses many advantages over other outdoor games. For example, the outdoor game of the present disclosure is easy to set up and easy to take down. Indeed, it requires only minutes to either set up or take down the game. In addition, the outdoor game of the present disclosure is lightweight and collapsible to facilitate transportation and storage. The outdoor game of the present disclosure can be enjoyed by players having a wide range of ages. In addition, the outdoor game of the present disclosure can be played by a single player or by larger groups of players that may separate into 2 or more teams. The outdoor game of the present disclosure is safe and provides some physical exercise to the players.

Figure 1:
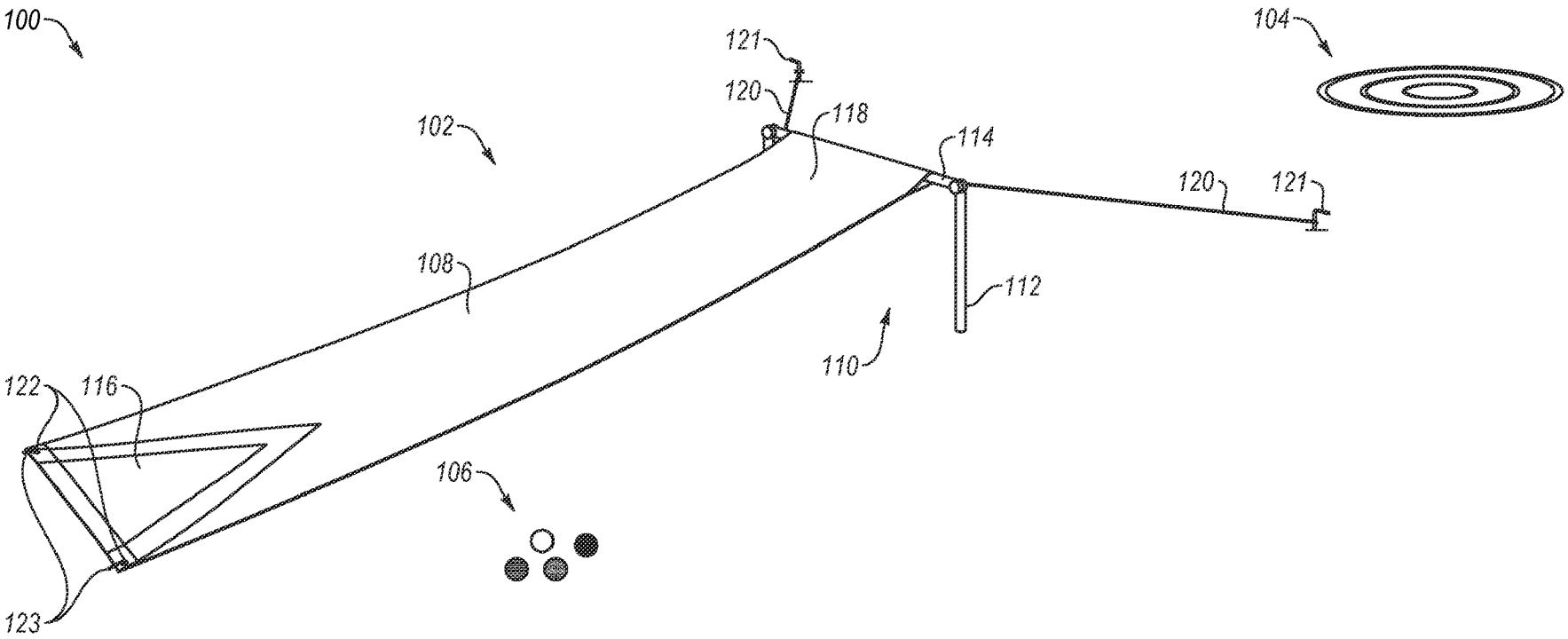
FIG. 1 is a perspective view of an example portable outdoor game.

Turning to the figures, FIG. 1 illustrates exemplary portable outdoor game 100. Outdoor game 100 includes a ramp 102, a target 104, and projectiles 106. Ramp 102 may include a runner 108 and an elevation structure 110. Runner 108 may be constructed from any number of different materials. In one embodiment, runner 108 may be a flexible material, such as fabric, vinyl, indoor/outdoor carpet, plastic, linen, etc. The edges of runner 108 may be treated with a seam sealer to prevent fraying. In one embodiment, runner 108 may be approximately 2 feet wide and approximately 9 feet long. In another embodiment, the runner may be approximately 2 feet wide and approximately 7 feet long.

Outdoor game 100 may be set up and played on any number of different outdoor surfaces. For example, outdoor game 100 may be set up and played on grass, sand, dirt, or another natural surface. The underside of runner 108 may include a waterproof or water-resistant treatment or backing to ensure that the top playing surface of runner 108 remains dry should outdoor game 100 be set up on a playing surface that is wet or damp.

Elevation structure 110 may include one or more legs 112 and a cross member 114. The one or more legs 112 and cross member 114 may each be approximately 2 feet in length. Elevation structure 110 can be constructed from any number of different materials, such as wood, plastic, metal, etc. The one or more legs 112 may be attached to cross member 114 in a manner that allows the one or more legs 112 to be reoriented relative to cross member 114. For example, the one or more legs 112 may be removably attached to cross member 114, such that the one or more legs 112 can be detached from cross member 114 and positioned parallel to cross member 114 when game 100 is not in use. Alternatively, the one or more legs 112 may be pivotally attached to cross member 114 through a hinge or other mechanism that allows the one or more legs 112 to collapse or fold under cross member 114 when game 100 is not in use. This removable or hinged connection between the one or more legs 112 and cross member 114 may reduce the amount of space required for storage when game 100 is not in use.

One or more legs 112 of outdoor game 100 may extend vertically downward from horizontal cross member 114 at approximately right angles. In other embodiments, the one or more legs extend away from cross member 114 at angles that are larger than 90 degrees. In such an embodiment, the distance between the bottoms of the one or more legs (where the leg members contact the playing surface) may be larger than the length of the cross member. This may provide some additional lateral stability to the elevation structure. In order to ensure the one or more legs rest flat on the playing surface, the bottoms of the one or more legs may be cut at an angle that is similar to or the same as the angle between the one or more legs and the cross member.

Runner 108 may include a first end 116 and a second end 118. Second end 118 of runner 108 may be secured to elevation structure 110. Second end 118 of runner 108 may be secured to elevation structure 110 in any number of different ways. For example, staples, nails, screws, or adhesive may be used to secure second end 118 of runner 108 to elevation structure 110. Alternatively, second end 118 may loop around cross member 114 and be glued, stitched or otherwise attached back to itself. First end 116 of runner 108 may include an anchoring mechanism that is configured to maintain runner 108 in a fixed position relative to a surface underlying outdoor game 100. For example, first end 116 of runner 108 may include one or more anchor points 122, where runner 108 may be secured to the playing surface below runner 108. These anchor points 122 may be holes or grommets near the corners of first end 116 of runner 108, through which stakes 123 may be inserted to secure runner 108 to the underlying playing surface.

Elevation structure 110, when positioned in an upright orientation creates an angled incline in runner 108 relative to the playing surface from first end 116 to second end 118 of runner 108. Elevation structure 110 may be held in an upright orientation by any number of different stabilizing mechanisms. For example, in outdoor game 100, elevation structure 110 is held in an upright position through the use of the runner 108 on one side (which may be anchored to an underlying surface as provided above) and one or more anchor lines or cords 120 on the other side of elevation structure 110. One end of anchor lines 120 may be secured to elevation structure 110 or second end 118 of runner 108 and an opposite end of anchor lines 120 may be secured to one or more stakes 121 that may be inserted into the playing surface. Alternatively, the opposite ends of anchor lines 120 may be secured to an object that rests on the playing surface, such as a rock or a weight. Anchor lines 120 may extend in a direction away from runner 108 such that the tension between runner 108 and anchor lines 120 maintains elevation structure 110 in an upright position.

The stakes used to secure the runner and/or anchor lines may vary in size, shape, and material depending on the playing surface. For example, stakes may be constructed from metal, plastic, or another material. Stakes designed for grass or dirt may be less than ½ inch in diameter and approximately 4 to 12 inches in length. Stakes designed for sand may be more than ½ inch in diameter and approximately 4 to 12 inches in length. These stakes may be straight or have a spiral shape that would allow a user to twist the stakes into the playing surface.

In alternative embodiments, elevation structure 110 may be held in an upright orientation via feet members that may be secured to the one or more legs 112. These feet members may extend away from the one or more legs 112 on the playing surface to provide vertical stability to the elevation structure. Alternatively still, stakes may extend directly from the one or more legs 112 and into the playing surface, thereby maintaining elevation structure 110 in an upright orientation.

Target 104 may or may not be connected to ramp 102. For example, in outdoor game 100, target 104 is not connected, either directly or indirectly, to ramp 102. Target 104 may form one or more closed geometric figures, such as circles, squares, ovals, diamonds, etc. Target 104 may be rigid such that the geometric shape defined by the target is predefined. Alternatively, target 104 may be constructed of a flexible cord such that a user may configure the target into a desired shape. This flexible cord may include a rope, string, yarn, chain, wire, or some other flexible material. In game 100, target 104 may be a length of cord that is secured at both ends to make a flexible loop or ring. For example, clear vinyl connectors may be used to hold the cord ends together. In alternative embodiments, the length of cord may not be secured at the ends. In some embodiments, the cord may be ¾ inch diameter polyester rope. Targets constructed of a flexible cord, may also facilitate more easily storing outdoor game 100 when it is not in use. Alternatively, target 104 may be configured to receive and hold the projectiles 106 within a defined and rigid area. For example, in this embodiment, the target may be a cup, bucket, box, etc.

A target may include a target backing. For example, a target may be one or more holes that are cut into a target backing and into which the one or more projectiles may fall. In this embodiment, the target backing may be positioned at an incline relative to the playing surface. The incline could be angled toward the ramp or it could be angled away from the ramp. Alternatively still, one or more targets may be painted, stitched or otherwise secured to a flat piece of material, such as a blanket or a tarp. This material may be placed on the playing surface and held in place by one or more stakes.

Target 104 may be placed at a selected location on the playing surface. Target 104 may rest directly on the playing surface such that the playing surface is the target backing. As provided previously, the playing surface may be a natural (not man-made) surface such as grass, dirt, or sand. In some embodiments, the target backing may be inclined or horizontal. The target backing may also be at approximately the same height as the first end 116 of runner 108. Alternatively, a target backing may be raised relative to the first end 116 of runner 108.

In some embodiments, a plurality of targets may be used. These targets may have different sizes and shapes and be placed at different locations on the playing surface, as well as at different elevations from the playing surface. In one embodiment, target 104 may comprise a plurality of differently sized rings oriented with larger rings on the outside and smaller rings on the inside, similar to an archery target. For example, a first target may have a diameter of approximately 3 feet 5 inches, a second target may have a diameter of approximately 2 feet, and a third target may have a diameter of approximately 1 foot.

In some embodiments, the target backing may be flat or nearly flat. For example, in embodiments where the playing surface is the target backing, target 104 may merely define an enclosed area on a flat surface. In other embodiments, targets may be defined within a target backing. For example, a target may define a hole in a made-made target backing, such as a piece of wood or plastic. Target 104 may be positioned behind ramp 102 such that target 104 may not be visible by a person standing near first end 116 of runner 108.

In other words, depending on the height of a user, ramp 102 may obstruct in whole or in part the user's view of target 104.

Projectiles 106 may have a number of different shapes, sizes, colors, and weights. Projectiles 106 may be constructed from a variety of different materials. For example, projectiles 106 may be constructed from polyurethane, rubber, felt, wood, a sponge material, etc. Projectiles may also be spherical shaped bags filled with a material such as sand, corn, ball bearings, beans, plastic, rice, etc. In one embodiment, projectiles 106 may have a weight of approximately 1.44 ounces. As shown in game 100, projectiles 106 may be spherical balls. In one embodiment, these spherical balls may have a diameter of approximately 2¾ inches. In other embodiments, the projectiles may have a cylindrical shape configured to roll on a rounded outer surface. In another embodiment, projectiles 106 may have a flat or disk shape and be configured to slide across runner 108. In this embodiment, runner 108 may be constructed from a slippery material that is configured to have a minimal amount of friction or resistance with the projectile.

Projectiles 106 may have smooth or rough outer surfaces. A player may use a technique similar to bowling to roll or slide the projectiles across runner 108 from first end 116 to second end 118. The angled incline in runner 108 created by elevation structure 110 may cause projectiles 106 to become airborne after rolling or sliding off of second end 118 of runner 108. Projectiles 106 may land within or near target 104.

Target 104 may have a point designation printed directly on target 104 or secured to a tag that is attached to target 104. If a user is able to land the projectile 106 within the boundaries defined by target 104, that user may receive the points identified by the target's point designation. In some embodiments, where multiple targets are used, different point designations may be printed on or secured to each of the multiple targets. Larger targets may have a point designation that is less than the point designation of smaller targets.

To play outdoor game 100, users may choose projectiles. Projectiles 106 may be distinguishable based on a color of the projectiles or a pattern/word/symbol that is printed on the projectiles. For example, outdoor game 100 may include 4 projectiles with 1 red, 1 blue, 1 yellow, and 1 green. Individuals playing outdoor game 100 may take turns rolling their projectile(s) across ramp and over elevation structure 110. If a player is able to land his or her projectile within the boundaries defined by target 104, he or she may receive the points assigned to that target. The use of score markers may be attached to the target material such as cord and may be used to determine the points assigned. In some embodiments, some projectiles may be worth additional points. For example, a particular ball may be worth twice the points of the target into which the ball lands.

Once each player has rolled each of their projectiles, the players may then go retrieve their projectiles. Point totals may be added up after each round. Point totals based on a single round may determine a winner. Alternatively, a winner may be determined based on accumulated point totals from two or more rounds. Alternatively still, a winner may be determined based on the player that is able to achieve a predetermined number of point first. In addition, a winner may be determined based on the player that has the most points after a set amount of time has expired. Outdoor game 100 may also be played through teams where each team comprises two or more players. Each player on a team may have a turn rolling a projectile and scoring points. Point totals from each member of the same team may be combined to determine a winning team as provided above.

In one embodiment, projectiles 106 and target 104 may be constructed from materials that float. In this embodiment, ramp 102 may be set up near a pool or other body of water such that when a user rolls or slides a projectile 106 down runner 108, it lands in the pool. Targets may be placed in the pool and points may be awarded based on projectiles that come to rest floating within the boundaries of the floating targets. Alternatively still, projectiles 106 and target 104 may be constructed from materials that sink. In this embodiment, targets may be placed at the bottom of the pool and points may be awarded based on projectiles that come to rest within target boundaries at the bottom of the pool.

In another embodiment, target 104 may be one or more pins that are set up in the target area. These pins may be shaped like bowling pins or they may be blocks, cups, or have another shape. To score points in this embodiment, a user would attempt to knock over the one or more pins in the target area with the projectiles. Each of the one or more pins may have an associated point value, so that if a player successfully knocks over a pin, he or she receives the points associated with that pin.

Figure 2A:
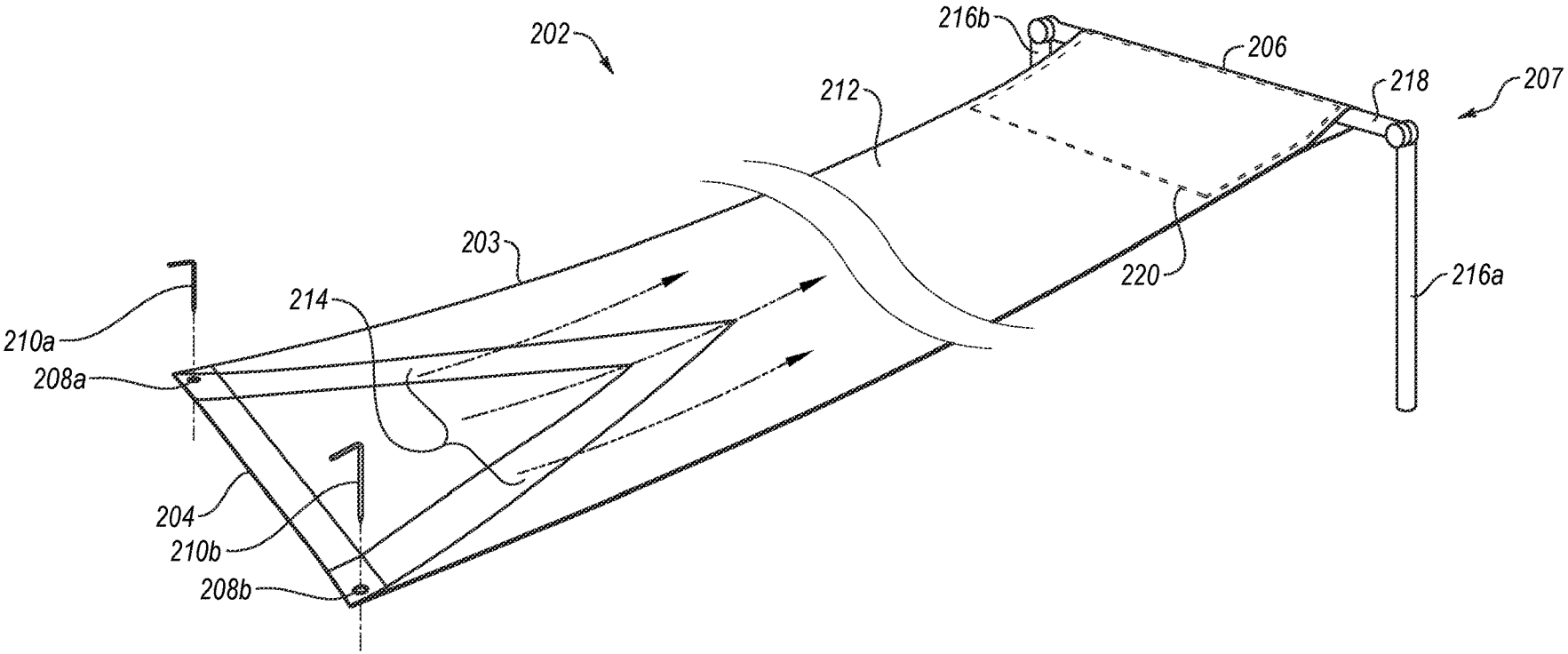
FIGS. 2A-2B are different views of an example ramp that may be used in a portable outdoor game.

FIG. 2A illustrates a top perspective view of an exemplary ramp 202. Ramp 202 may include a runner 203. Runner 203 may include a first end 204 and a second end 206. Second end 206 may be secured to an elevation structure 207. First end 204 may include an anchoring mechanism that is configured to secure runner 203 to an underlying surface. For example, runner 203 includes grommets 208*a* and 208*b* through which stakes 210*a* and 210*b* may secure runner 203 to an underlying surface. Runner 203 includes a top side 212, which is illustrated in FIG. 2A. Top side 212 may include guides, such as lines and arrows 214, to provide aiming points for players.

Elevation structure 207 may include a first leg 216*a*, a second leg 216*b*, and a cross member 218. First and second legs 216*a* and 216*b* may be attached to opposite sides of cross member 218. First and second legs 216*a* and 216*b* may be attached to cross member 218 in a way that allows the first and second legs 216*a* and 216*b* to be reoriented relative to cross member 218. For example, first and second legs 216*a* and 216*b* may be removably or pivotally attached to cross member 218.

Ramp 202 may also include a cushion member 220. Cushion member 220 may be positioned between runner 203 and cross member 218 of elevation structure 207. Cushion member 220 may extend the entire width of cross member 218 or runner 203 or some portion of either cross member 218 or runner 203. Cushion member may also extend all or some part of the length of runner 203. For example, cushion member 220 may extend from cross member 218 and below runner 203 for between 1 inch and 2 feet from elevation structure 207. Cushion member 220 may be constructed from any number of different pliable materials such as rubber, foam, etc. Cushion member 220 may be configured to eliminate or reduce an impact between a projectile rolling on runner 203 and cross member 218 of elevation structure 207. In addition, cushion member 220 may provide some "bounce" for a projectile as it travels over the cushion member 220.

Figure 2B:
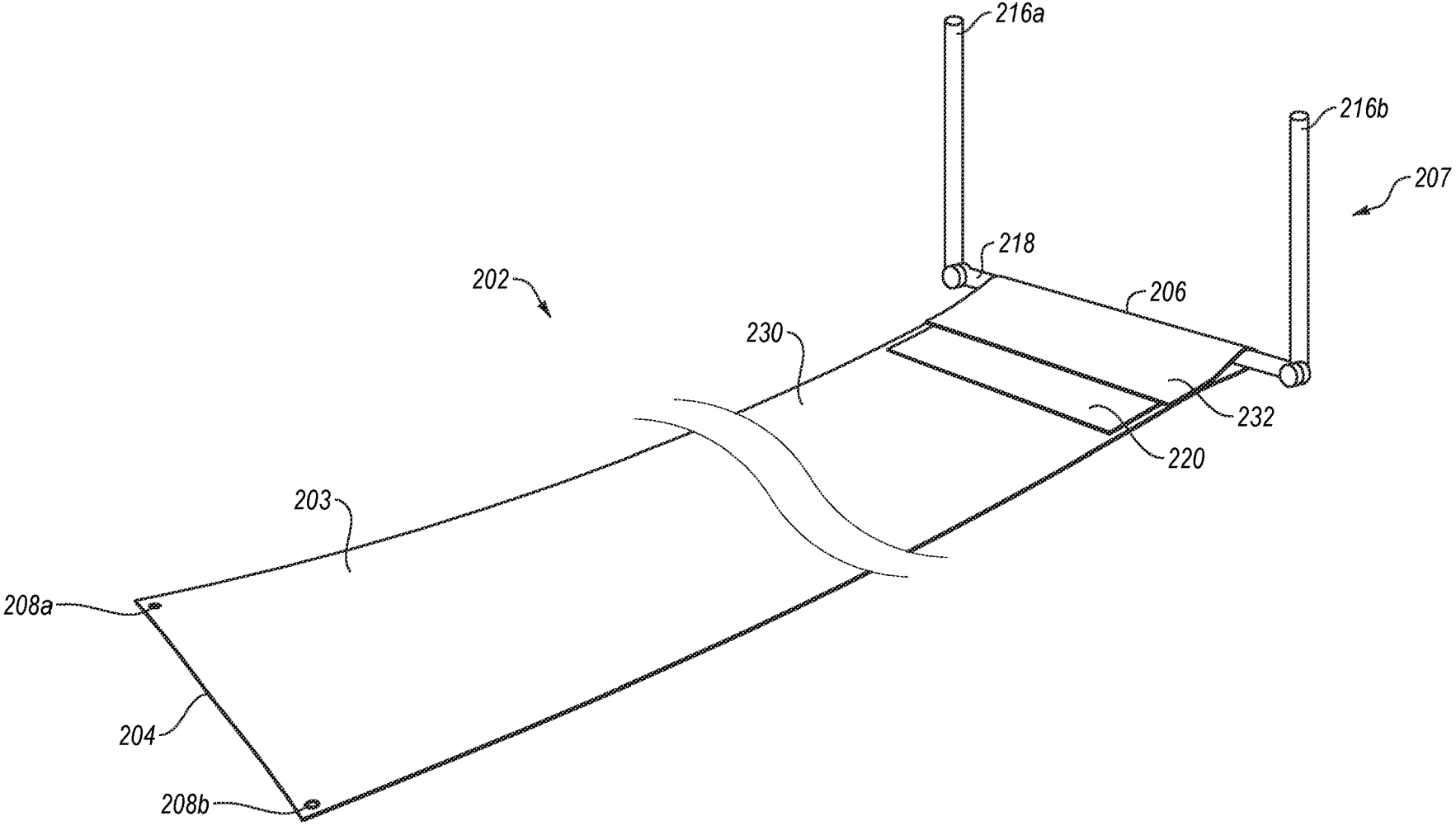

FIG. 2B illustrates a bottom perspective view of ramp 202. Runner 203 of ramp 202 includes a bottom side 230. Bottom side 230 of runner 203 may include a water resistant or waterproof material such that runner 203 is made of two separate materials that may be stitched or glued together.

Alternatively, runner 203 may be a single material and bottom side 230 may be treated with a water resistant or waterproof product.

Runner 203 may be secured to elevation structure 207 by looping a portion of runner 203 around cross member 218 and then securing runner 203 back to itself at seam 232. Seam 232 may be created by, for example, stitching or gluing a portion of runner 203 back onto itself. Cushion member 220 may be secured to bottom side 230 of runner 203. For example, an adhesive may be used to secure cushion member 220 to bottom side 230 of runner 203. Alternatively, cushion member 220 may be stitched to bottom side 230 of runner 203.

Figure 3A:
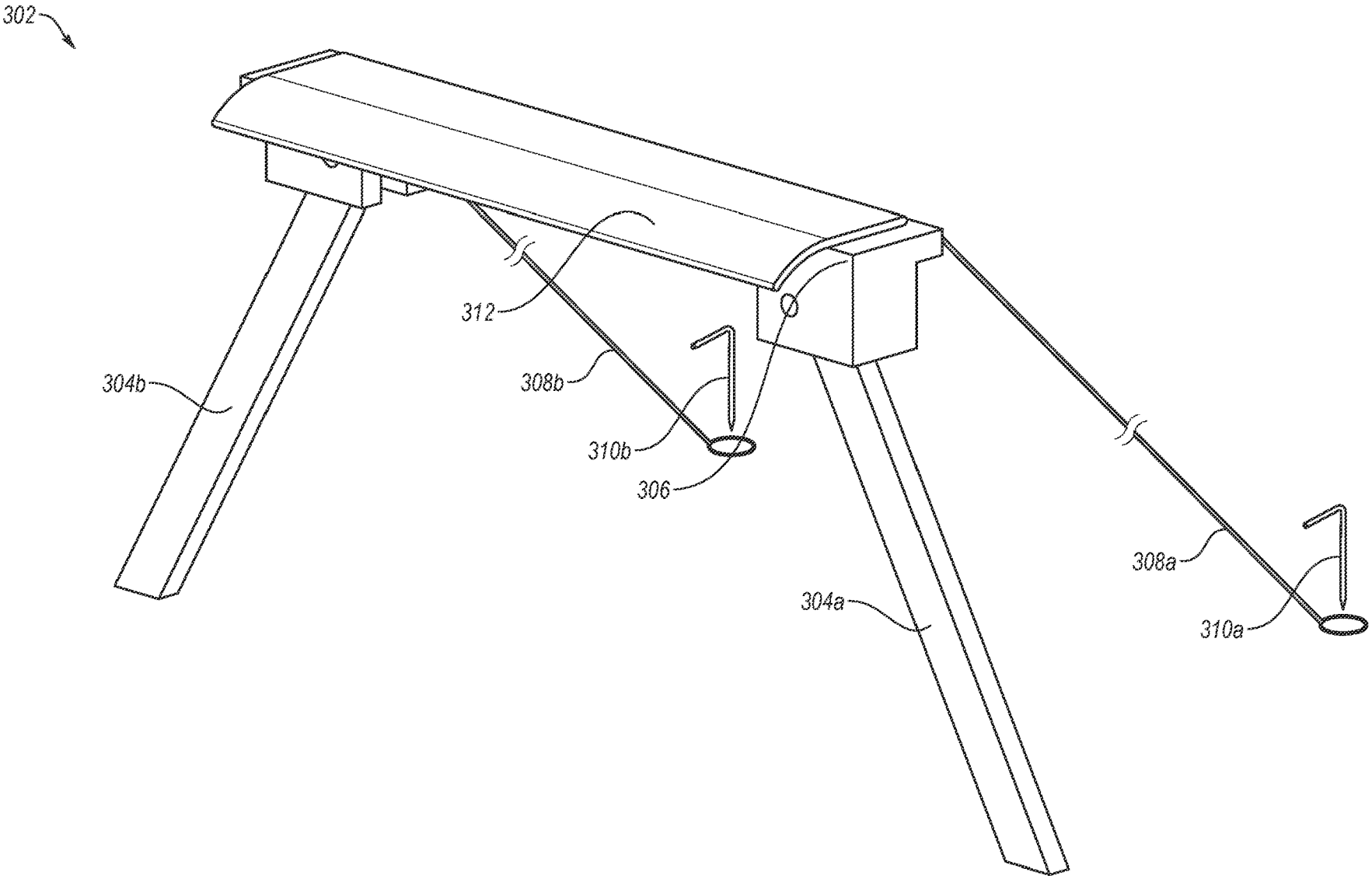
FIG. 3A-3D are different views of an example elevation structure that may be used in a portable outdoor game.

FIGS. 3A-3D illustrate an exemplary elevation structure 302. FIG. 3A illustrates a perspective view of elevation structure 302, which includes first and second legs 304*a* and 304*b*, and a cross member 306. First and second legs 304*a* and 304*b* may be secured to cross member 306 in a way that allows first and second legs 304*a* and 304*b* to be reoriented relative to cross member 306. Elevation structure 302 also includes anchor lines 308*a* and 308*b*. These anchor lines may be secured to elevation structure 302 at one end and include a loop at an opposite end through which stakes 310*a* and 310*b* may be inserted to maintain elevation structure 302 in an upright position.

Elevation structure 302 also includes a cushion member 312 that is configured to be positioned between cross member 306 and a runner (not shown) that is secured to elevation structure 302. Cushion member 312 may be secured to a top portion of cross member 306 or to an underside of a runner at or near the end that is secured to an elevation structure. For example, nails or an adhesive may be used to secure cushion member 312 to cross member 306. Cushion member 312 may extend all or a part of the length of cross member 306 and all or a part of the width of cross member 306. Cushion member 312 may provide some support to a portion of runner that lies directly in front of elevation structure 302. In some embodiments, the portion of runner to which cushion member 312 provides support may be as little as an inch. In other embodiments, the cushion member may provide support to a much larger portion of runner. For example, a cushion member may extend below a runner for 2 feet from an elevation structure. Cushion member 312 may have any thickness. In one embodiment, cushion member 312 may be approximately 2 millimeters thick. The support provided by cushion member 312 may help to eliminate or reduce an impact between a projectile rolling on a runner and cross member 306 of elevation structure 302. In addition, cushion member 312 may provide some "bounce" for a projectile as it travels over the cushion member 312.

Figure 3B:
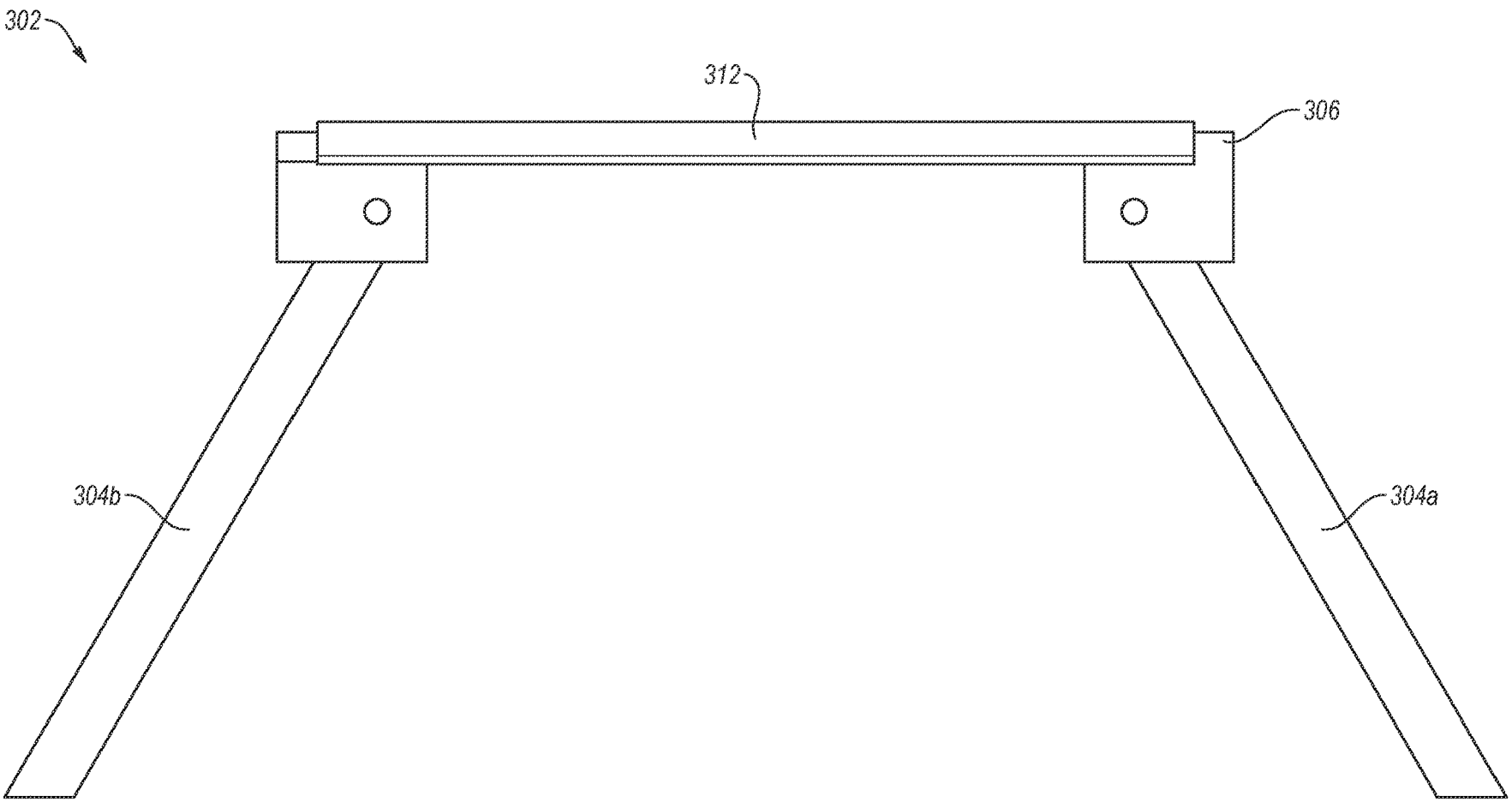

FIG. 3B illustrates a front view of elevation structure 302. Cross member 306, and each of legs 304*a* and 304*b* may have a length of approximately 2 feet. When configured in an upright position, cross member 306 may be held approximately 15.5 inches above a playing surface by first and second legs 304*a* and 304*b*. As can be seen in FIG. 3B, first and second legs 304*a* and 304*b* extend away from cross member 306 at angles that create a wider stance for first and second legs 304*a* and 304*b*. This wider stance may provide some additional lateral stability to elevation structure 302. A bottom portion of first and second legs 304*a* and 304*b* may be cut at angles to ensure a flush contact between legs 304*a* and 304*b* and an underlying surface on which elevation structure 302 is positioned.

Figure 3C:
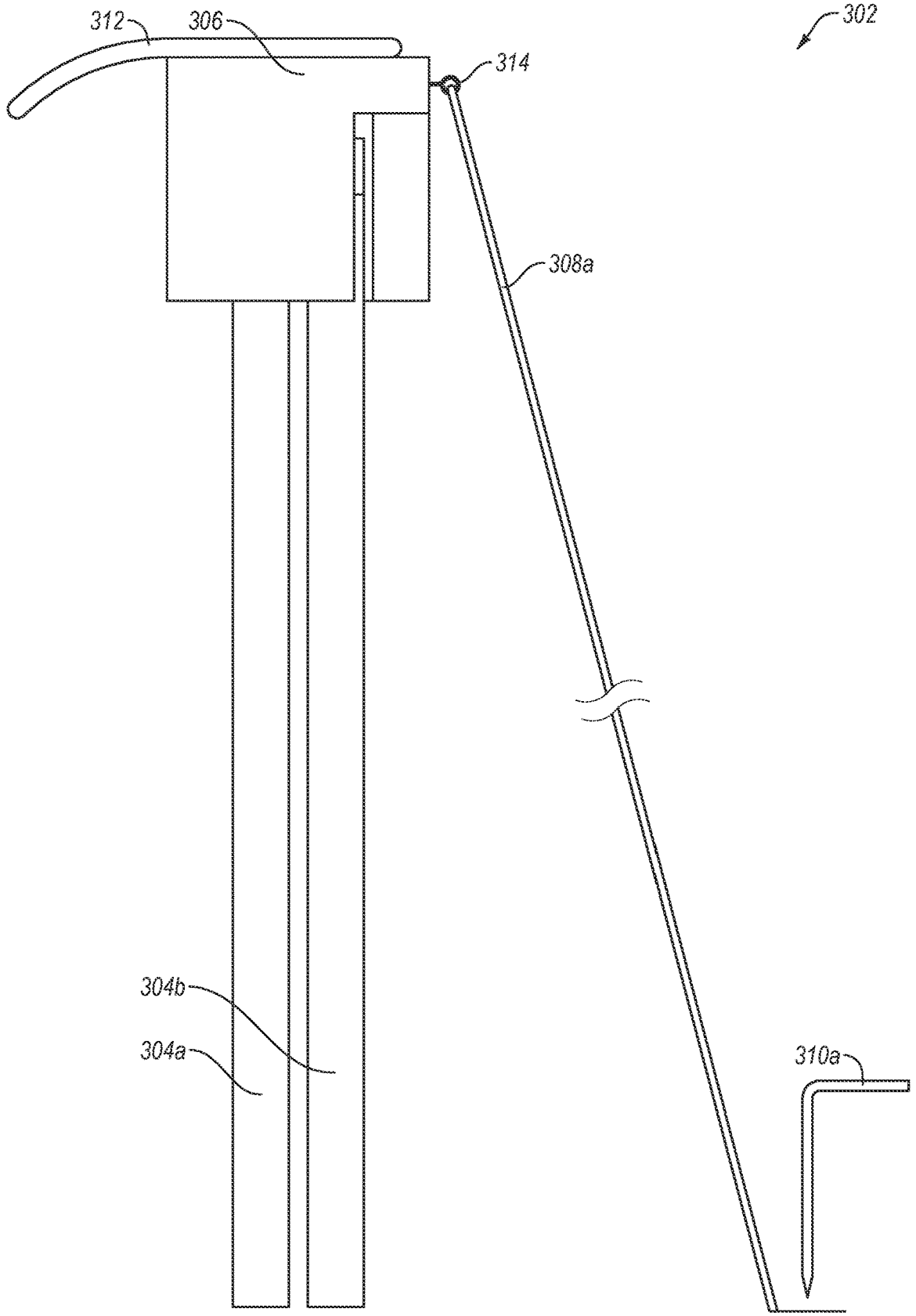
Figure 3D:
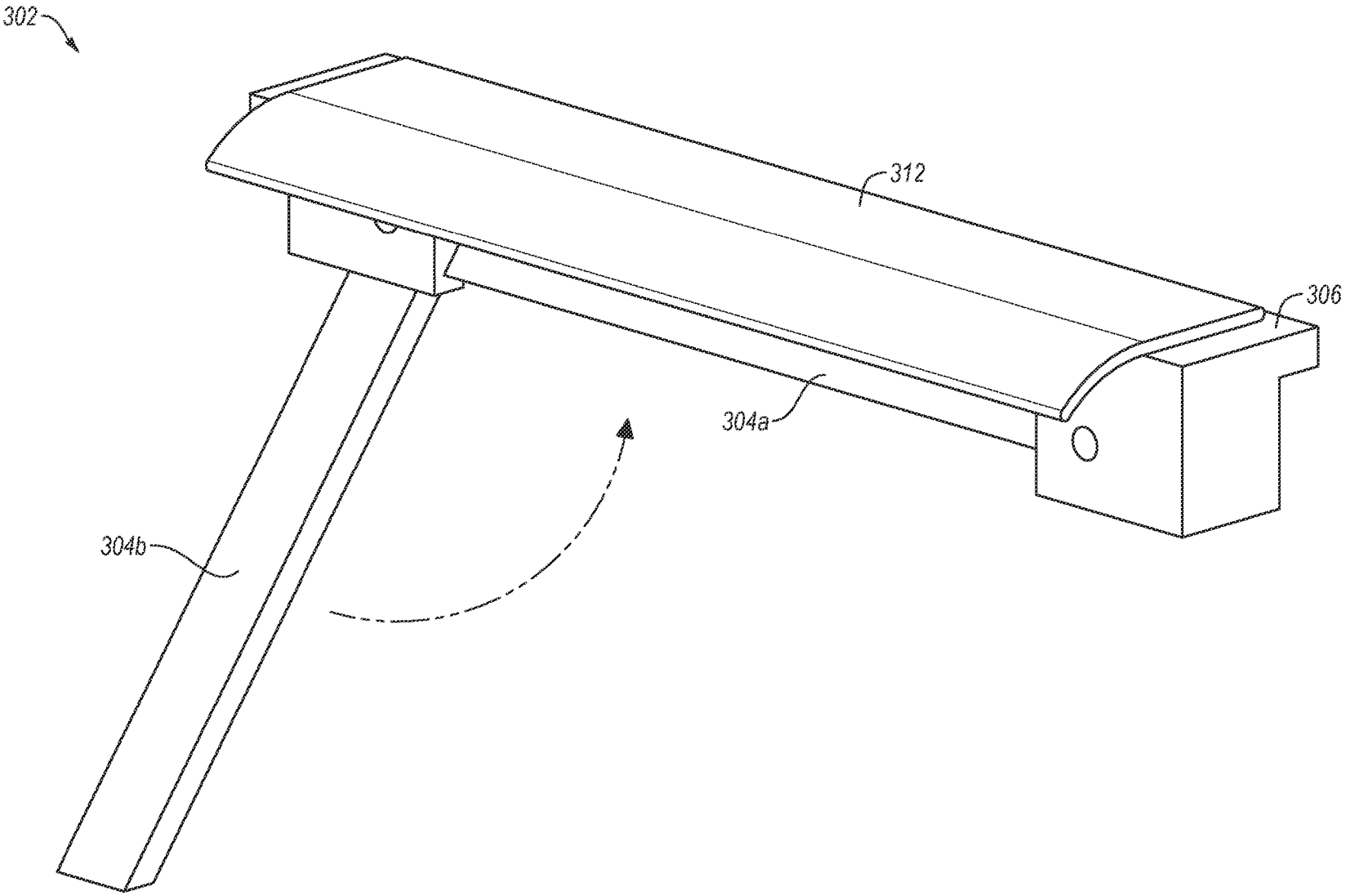

FIG. 3C illustrates a side view of elevation structure 302. As can be seen in FIG. 3C, anchor line 308*a* is secured to elevation structure 302 via a screw eye 314. In alternative embodiments, anchor lines 308*a* and 308*b* may be simply tied to or connected in another way to elevation structure 302. First and second legs 304*a* and 304*b* may be secured via hinges to cross member 306. First and second legs 304*a* and 304*b* may be offset below cross member 306 so that each of legs 304*a* and 304*b* may be able to collapse below cross member 306 without creating an obstruction for the other. FIG. 3D illustrates a perspective view of a partially collapsed elevation structure 302. As can be seen in FIG. 3D, first leg 304*a* has been folded under cross member 306.

Figure 4:
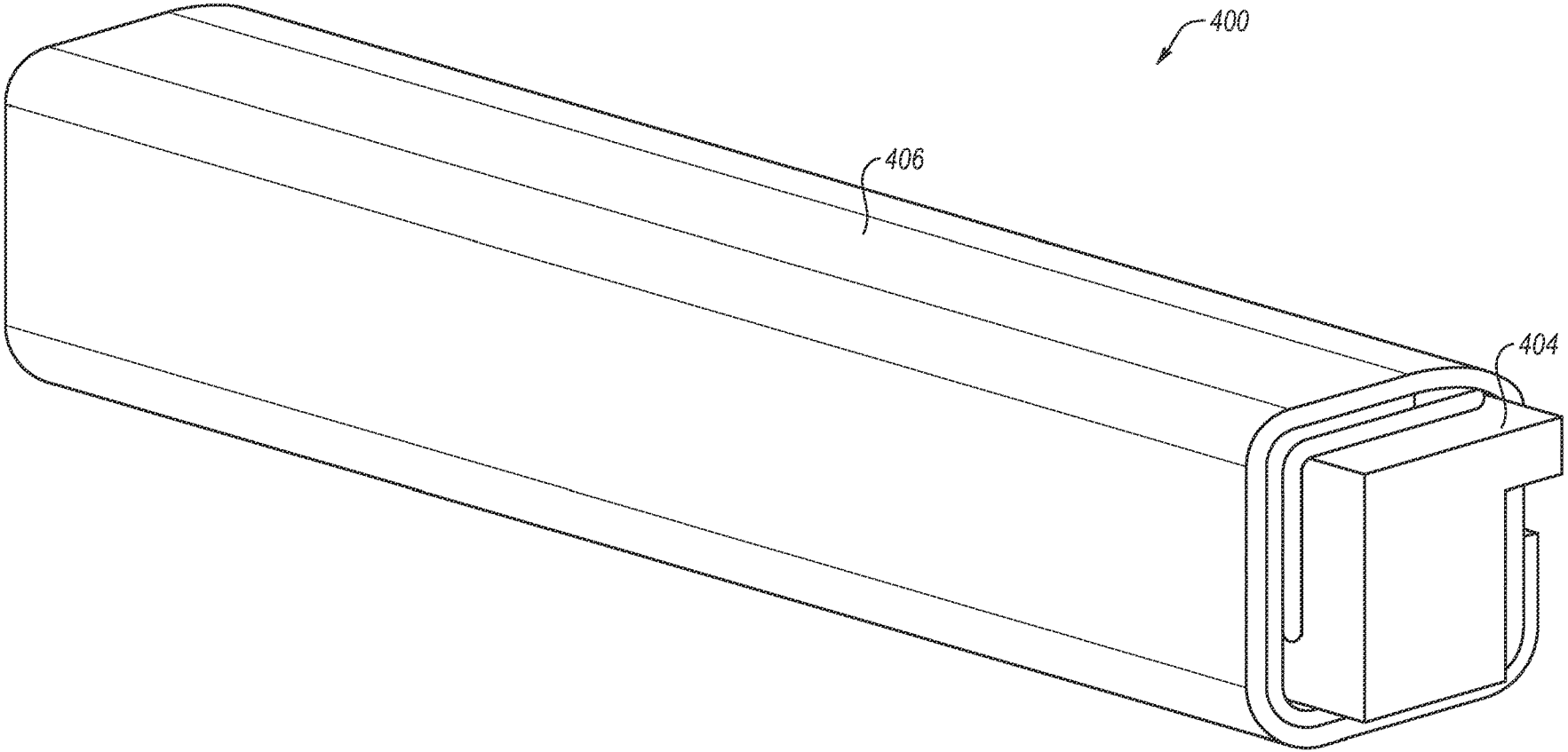
FIG. 4 is another example of an outdoor game.

FIG. 4 illustrates an outdoor game 400. Outdoor game 400 includes a cross member 404 and first and second legs. First and second legs of outdoor game 400 are collapsed below cross member 404. Outdoor game 400 also includes a runner 406. Runner 406 is made from a flexible material and has been rolled around first and second legs and cross member 404 making a compact package that is easy to transport and store when outdoor game 400 is not in use.

Figure 5:
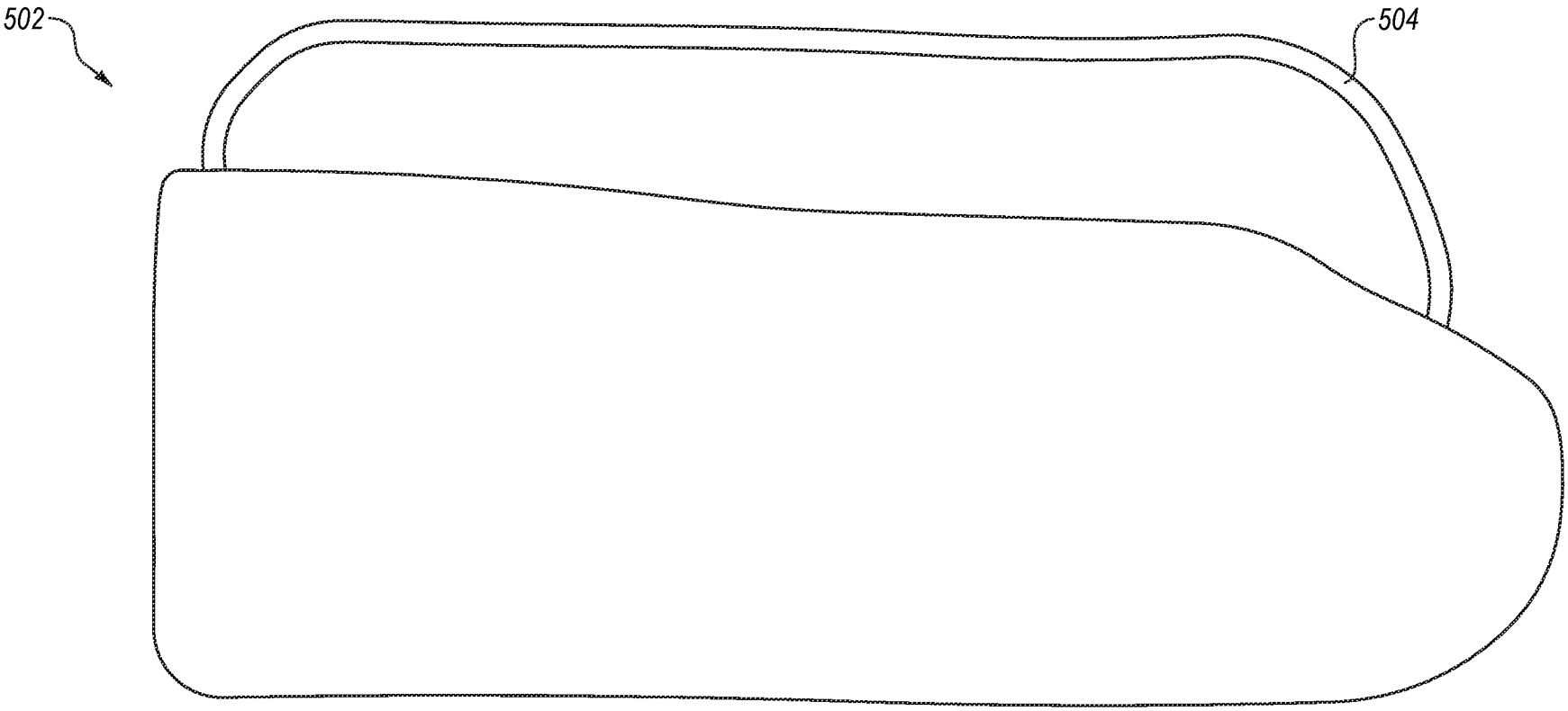
FIG. 5 is an example of a bag that may be used to contain a portable outdoor game.

FIG. 5 illustrates a storage bag 502. An outdoor game according to the present disclosure may be contained within storage bag 502. For example, storage bag 502 may contain a ramp, one or more targets, one or more projectiles, anchor lines, and stakes. Storage bag 502, including the outdoor game it contains, may be lightweight. For example, storage bag 502, including the outdoor game it contains, may weigh 10 pounds or less. Storage bag 502, including the outdoor game it contains, is also small and highly portable. For example, storage bag 502, including the outdoor game it contains, may be approximately 26 inches long, approximately 12 inches wide, and approximately 12 inches tall. Storage bag 502 may further include a strap or handle 504 to further facilitate portability.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for-purposes of example rather than limitation, and does not preclude inclusion of such modifications, variations, and/or additions to the present subject matter as would be readily apparent to one of ordinary skill in the art.

The invention claimed is:

1. A portable outdoor game comprising:

a ramp including:

an elevation structure having one or more legs and a cross member, wherein one end of the one or more legs is configured to rest on an underlying playing surface and an opposite end of the one or more legs is attached to the cross member, a flexible runner having a first end and a second end, the first end having one or more grommets through which one or more stakes may be inserted securing the runner to the underlying playing surface and the second end being secured to the cross member, and one or more anchor lines attached to the elevation structure at one end and configured to be secured to the underlying playing surface at the other end, wherein the elevation structure is configured to be held in an upright position on the one or more legs by the runner on one side and the one or more anchor lines on an opposite side, wherein the ramp is configured to allow one or more projectiles to travel across the runner from the first end of the runner to the second end of the runner and become airborne after traveling off of the second end of the runner;

a target configured to rest on the playing surface, wherein the target defines an enclosed area and lacks any connection to the ramp; and one or more projectiles that are configured to travel across the runner from the first end of the runner to the second end of the runner and become airborne after traveling off of the second end of the runner toward the area defined by the target.

2. The portable outdoor game of claim 1, wherein the one or more legs include a first leg and a second leg and wherein the first leg is attached to one end of the cross member and the second leg is attached to an opposite end of the cross member.

3. The portable outdoor game of claim 1, wherein the one or more legs are removably attached to the cross member, such that the one or more legs may be reoriented relative to the cross member.

4. The portable outdoor game of claim 1, wherein the one or more legs are pivotally attached to the cross member, such that the one or more legs may be reoriented relative to the cross member.

5. The portable game of claim 1, wherein the elevation structure further includes a cushion member positioned below the runner near the second end of the runner, wherein a first portion of the cushion member is positioned between the runner and the cross member and a second portion of the cushion member extends below a portion but not the entire length of the runner and away from the cross member.

6. The portable game of claim 1, wherein the runner includes a top side and a bottom side and wherein one or more guides that are configured to provide indicators for the one or more projectiles are printed on the top side of the runner.

7. The portable game of claim 1, wherein the target is a length of cord.

8. The portable game of claim 7, wherein the cord is connected at each end to create a closed loop.

9. The portable game of claim 1, wherein the projectiles are balls that are configured to roll across the runner.

10. A ramp configured to be used in a portable outdoor game, the ramp comprising:

an elevation structure including a first leg, a second leg, and a cross member having a first end and a second end, wherein the first end of the cross member is attached to the first leg and the second end of the cross member is attached to the second leg;

an elongated runner having a first end and a second end, the first end of the elongated runner having one or more grommets through which one or more stakes may be inserted securing the runner to an underlying playing surface and the second end of the elongated runner being secured to the cross member;

a cushion member positioned below the runner near the second end of the runner, wherein a first portion of the cushion member is positioned between the runner and the cross member and a second portion of the cushion member extends below a portion but not the entire length of the runner and away from the cross member; and one or more anchor lines attached to the elevation structure at one end and configured to be secured to the underlying playing surface at the other end, wherein the elevation structure is configured to be held in an upright position on the first and second legs by the runner on one side and the one or more anchor lines on an opposite side, wherein the ramp is configured to allow one or more projectiles to travel across the runner from the first end of the runner to the second end of the runner and become airborne after traveling off of the second end of the runner.

11. The ramp of claim 10, wherein the runner has a top side and a bottom side and wherein the cushion member is secured to the bottom side of the runner.

12. The ramp of claim 11, wherein the cushion member is secured to the bottom side of the runner by an adhesive.

13. The ramp of claim 10, wherein the cushion member is secured to the elevation structure.

14. The ramp of claim 10, wherein the cushion member is made from rubber or foam.

15. The ramp of claim 10, wherein the second portion of the cushion member extends from the elevation structure and below the runner for a distance of at least 1 inch from the cross member.

16. The ramp of claim 10, wherein the cushion member has a thickness of approximately 2 millimeters.

17. The ramp of claim 10, wherein the first and second legs are pivotally attached to the cross member such that the first and second legs may be reoriented relative to the cross member.

18. The ramp of claim 10, wherein the runner includes a top side and a bottom side and wherein one or more guides lines or arrows are printed on the top side of the runner.

19. A portable outdoor game comprising:

a ramp including:

an elevation structure including a first leg, a second leg, and a cross member having a first end and a second end, wherein the first end of the cross member is attached to the first leg and the second end of the cross member is attached to the second leg, wherein the first and second legs are attached to the cross member in a manner that allows the first and second legs to be reoriented relative to the cross member, an elongated runner having a first end and a second end, the first end of the elongated runner having one or more grommets through which one or more stakes may be inserted securing the runner to an underlying playing surface and the second end of the elongated runner being secured to the cross member, and one or more anchor lines attached to the elevation structure at one end and configured to be secured to the underlying playing surface at the other end, wherein the elevation structure is configured to be held in an upright position on the first and second legs by the runner on one side and the one or more anchor lines on an opposite side, wherein the ramp is configured to allow one or more projectiles to travel across the runner from the first end of the runner to the second end of the runner and become airborne after traveling off of the second end of the runner;

a target configured to rest directly on the playing surface, wherein the target defines an enclosed area and lacks any connection to the ramp; and one or more projectiles that are configured to travel across the runner from the first end of the runner to the second end of the runner and become airborne after traveling off of the second end of the runner toward the area defined by the target.

20. The outdoor game of claim 19, wherein the playing surface is a natural surface.

* * * * *